US005346225A

United States Patent [19]

Walling

[11] Patent Number: 5,346,225

[45] Date of Patent: Sep. 13, 1994

[54] TILE GAME AND METHOD OF PLAYING SAME

[76] Inventor: Jack Walling, 500 Aurora-Hudson Rd., Aurora, Ohio 44202

[21] Appl. No.: 170,000

[22] Filed: Dec. 17, 1993

[51] Int. Cl.[5] ..... A63F 9/20

[52] U.S. Cl. ..... 273/294

[58] Field of Search ..... 273/292, 294

[56] References Cited

U.S. PATENT DOCUMENTS

| | | | |
|---|---|---|---|
| 278,646 | 5/1883 | Williams | 273/292 |
| 1,121,989 | 12/1914 | Dreyer | 273/294 |
| 2,683,604 | 7/1954 | Hassan | 273/294 |
| 2,824,741 | 2/1958 | Wiley | 273/294 X |
| 3,638,947 | 2/1972 | Hardesty | 273/294 |
| 3,687,455 | 8/1972 | Odier | 273/294 |

*Primary Examiner*—William H. Grieb

*Attorney, Agent, or Firm*—Renner, Kenner, Greive, Bobak, Taylor & Weber

[57] ABSTRACT

A domino-like game having a plurality of hexahedronal playing pieces, or tile. Each tile has a playing face that projects an overall outline that can be classified as being one of six distinct quadrilateral shapes—viz.: a rectangular shape; three trapezoidal shapes; and, two rhomboidal shapes. Each tile presents two indicia-presenting portions. The rectangularly shaped tile is divided into two, square, indicia-presenting portions. Two trapezoidal tile shapes are divided into a square indicia-presenting portion and a trapezoidal indicia-presenting portion, and those two trapezoidal shapes are mirror-images of each other. The third trapezoidal shape, as are the two rhomboidal shapes, are divided into two, equal, trapezoidal indicia-presenting portions. One rhomboidal shape is a mirror-image of the other. All the tile shapes have laterally spaced, parallel, side edges, but the transverse end edges may either be orthogonally or obliquely oriented with respect to the laterally spaced, side edges. The oblique end edges intersect the parallel side edges at specifically selected, angular orientations. Each indicia-presenting portion is provided with an indicia, and the indicia are either dots or blanks. The tile are all sized such that the oblique end edges may be disposed in mutual abutment, without overlap, and the square sides may be similarly disposed in mutual abutment.

9 Claims, 5 Drawing Sheets

TILE GAME AND METHOD OF PLAYING SAME

TECHNICAL FIELD

The present invention relates generally to games. More particularly, the present invention relates to tile placement games. Specifically, the present invention relates to a domino-type, tile placement game wherein the quadrilateral playing faces on a hexahedronal tile all have at least two, parallel, lateral sides, but one or both of the intersecting ends that extend transversely between the parallel sides on at least some to the tiles are non-orthogonal—i.e.: they are obliquely disposed—with respect to the parallel sides.

BACKGROUND OF THE INVENTION

Dominos is a well known game that is played with hexahedronal tile pieces, each of which have an upper, obverse, rectangular playing face that is divided into two, square, indicia-presenting portions. The laterally spaced, longer sides of the rectangular playing face are each twice the length of the shorter sides, thus permitting the playing face to be divided into two, square, indicia-presenting portions. A number of dots may be embossed, or imprinted, on each square portion of the playing face to serve as indicia. In addition, one or both of the square portions may be left blank inasmuch as a blank may constitute one form of the indicia. The thickness of the tile—as measured to reflect the dimension of each edge surface which extends between the obverse and the reverse faces on each tile—is generally on the order of about one-third the dimension of the shorter sides of the rectangular, obverse playing face in order to permit the tile to stand on its side and thereby preclude competitors from seeing the indicia on any of the opponent's tile.

The domino game tile are believed to have originated in the eighteenth century, and it is thought that the domino was inspired by the presentation of indicia on the exposed, upwardly facing surfaces of a pair of dice. As such, the playing surface of a set of dominos represent all twenty-one (21) of the numerical combinations that could be presented by a pair of dice. By adding the blank as an additional indicia, the number of distinctly different tile available for a domino game was increased to twenty-eight (28). With a standard domino game, the indicia appearing on each square indicia-presenting portion is, in addition to the blank surface, limited to from one (1) to six (6) dots. This basic version is sometimes designated as a "double-six" domino set.

A version of the game entitled "double-nine" dominos, that also has only a rectangular playing surface on each tile, is also available. As might be expected, the number of dots utilized in that version of the game number from one (1) to nine (9), inclusive, and even in that version one or both of the square areas may be blank. The double-nine set provides fifty-five (55) distinctly different tile.

In an effort to increase the number of playing pieces even further, it is known to combine two or more sets of dominos. Thus, with two, double-six sets fifty-six (56) tile are available, and with two, double-nine sets one hundred and ten (110) tile are available. The use of a double-nine set, or combining two or more domino sets, will increase the total number of plays available, but the strategy of the game will not be affected.

The game of dominos is played by abutting the ends, or edges, of an indicia-presenting portion on one domino to an end, or edge, of an indicia-presenting portion on another domino—the rules requiring that the indicia on the abutting, indicia-presenting portions have the same numerical value. As the game is played, an orthogonal pattern is developed. That is, all of the tile are abutting at an included angle of either ninety degrees (90°) or one hundred eighty degrees (180°). Due to the use of square indicia-presenting surfaces, the number of combinations, and therefore the number of distinctly different tile, is limited. Also, the patterns made while playing are limited to orthogonal displays.

SUMMARY OF THE INVENTION

It is, therefore, a primary object of the present invention to provide a novel tile placement game, as well as novel tile for playing the new game, whereby the number of distinctly different tile is significantly increased, and yet the rules remain sufficiently similar to the rules governing the play of the historic double-six, or double-nine, domino game that the new game remains available for enjoyment by people falling within the full range of ages who have enjoyed playing dominos through the years.

It is another object of the present invention to provide an improved tile placement game, and the tile for playing the new game, as above, wherein the obverse playing face on each tile has at least two, laterally spaced, parallel side edges.

It is a further object of the present invention to provide an improved tile placement game, and the tile for playing the new game, as above, wherein each obverse, playing face delineates one of three distinct geometric shapes—i.e.: the obverse playing face on the placement tile have either trapezoidal, rhomboidal or rectangular configurations.

It is still another object of the present invention to provide an improved tile placement game, and the tile for playing the new game, as above, wherein the geometric outline of each non-orthogonal, obverse, playing face has at least one included angle of sixty-seven and one-half degrees (67½°).

It is yet another object of the present invention to provide an improved tile placement game, and the tile for playing the new game, as above, wherein the geometric outline of one or more playing faces has at least one included angle of ninety degrees (90°).

It is a still further object of the present invention to provide an improved tile placement game, and the tile for playing the new game, as above, wherein each obverse, playing face is divided into two indicia-presenting portions.

It is an even further object of the present invention to provide an improved tile placement game, and the tile for playing the new game, as above, wherein the two indicia-presenting portions on each obverse, playing face have equal areas.

These and other objects of the invention, as well as the advantages thereof over existing and prior art forms, which will be apparent in view of the following detailed specification, are accomplished by means hereinafter described and claimed.

The present invention constitutes an improvement to domino-type tile placement games by providing uniquely distinct playing tile that can be used with each other as well as with the customary domino-type tile. The number of uniquely distinct playing tile provided by the present invention is markedly increased over the number of tile available in standard domino games. As such, the number of playing combinations is increased, and the patterns formed are not limited to orthogonal layouts. According to the concepts of the present invention, some of the tile incorporate an obverse playing face in the shape of a rectangle; some tile incorporate an obverse playing face in the shape of a trapezoid; and, some tile incorporate an obverse playing face in the shape of a rhomboid. This concept permits many additional playing combinations.

The playing face on all tile has at least two, parallel, side edges. Two of the trapezoidal playing faces have one, obliquely oriented, short, transverse, end edge that extends between the parallel sides. One of the trapezoidal playing faces has two, obliquely oriented, short, transverse, end edges that extend between the parallel side edges. The rhomboid playing face has two obliquely oriented, short, transverse end edges that are parallel with each other. All of the oblique end edges of the playing tile have the same length such that they can be abutted without either end edge extending beyond the other. However, the oblique end edges are longer than the end edges but shorter than the side edges of the playing faces on the rectangular tile. Thus, the oblique end edge would extend beyond, or overlap, the end edges of the rectangular playing tile, if placed in abutment therewith.

The area of the indicia-presenting portions on all playing faces are equal. This is accomplished by making the average length of the longest, parallel, lateral sides of the trapezoids and rhomboids equal to the length of one of the longer of the parallel, lateral sides on the rectangular playing face. Two of the trapezoidal playing surfaces have one square indicia-presenting portion and one trapezoidal indicia-presenting portion. The square indicia-presenting portion will present three equal length sides—two lateral and one end—that can be abutted by the end of another square, indicia-presenting portion having the same indicia. However, the obliquely oriented end edge on the trapezoidal, indicia-presenting portions can only be abutted by another obliquely oriented end edge of a trapezoidal indicia-presenting portion having the same indicia. This permits non-orthogonal patterns to be developed during the play of the improved game defined by this invention. The indicia-presenting portions of all tile are separated either by a line, or other divider, that is orthogonal with respect to the parallel, lateral side edges of the tile.

In general, a tile placement game embodying the concepts of the present invention utilizes playing tile which present a playing surface that is defined by at least two laterally spaced, parallel sides that are conjoined by sides that are preselected to lie at an included angle of either: ninety degrees (90°); sixty-seven and one-half degrees (67½°): or, one hundred, thirty-five and one-half degrees (135½°) with respect to one or the other of the parallel sides.

To acquaint persons skilled in the arts most closely related to the present invention, one preferred embodiment of a tile placement game that illustrates a best mode now contemplated for putting the invention into practice is described herein by, and with reference to, the annexed drawings that form a part of the specification. The exemplary tile placement game is described in detail without attempting to show all of the various forms and modification in which the invention might be embodied. As such, the embodiment shown and described herein is illustrative, and as will become apparent to those skilled in these arts can be modified in numerous ways within the spirit and scope of the invention; the invention being measured by the appended claims and not by the details of the specification.

DESCRIPTION OF AN EXEMPLARY EMBODIMENT

Figure 1:
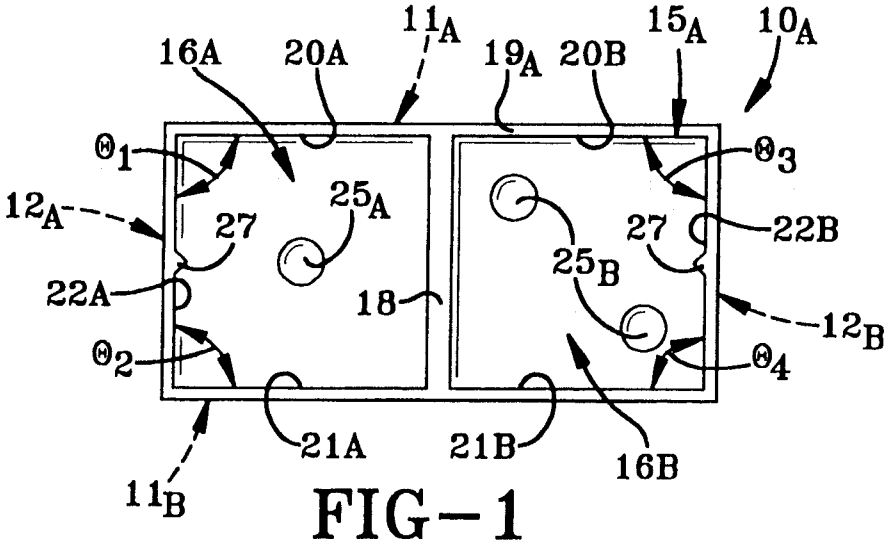
FIG. 1 is a plan view of a placement tile having an obverse playing face in the configuration of a rectangle and adapted to be used in a tile placement game embodying the concepts of the present invention.
Figure 2:
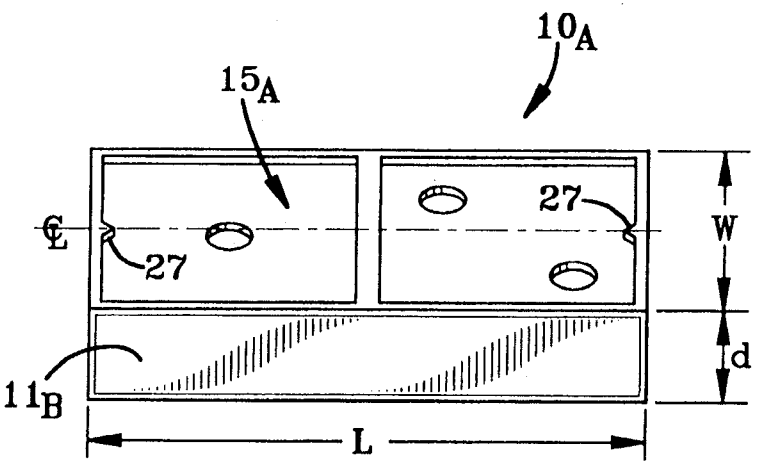
FIG. 2 is a perspective view of the playing tile depicted in FIG. 1.

With reference to FIGS. 1 and 2, a typical rectangular tile $10_A$ is depicted. The tile $10_A$ is a hexahedron with laterally spaced, parallel, side edge surfaces $11_A$ and $11_B$ as well as transverse end edge surfaces $12_A$ and $12_B$, the depth "d" of all the edge surfaces 11 and 12 may be substantially equal to one-third (⅓) the length of either transverse end edge surface 12 in order to permit the tile to stand on its side edge surfaces 11 or 12 with independent stability. However, a more compact set of tiles may be provided, if the thickness is substantially reduced. In that situation, however, it may be necessary, or desirable, for the player to position his or her tiles on a supporting rack.

The rectangular playing face $15_A$ on tile $10_A$ is divided into two, indicia-presenting portions 16A and 16B. The indicia-presenting portions 16A and 16B are square and are visually divided by a line, or by the moderately raised, transverse, divider 18, for reasons more fully hereinafter described. The perimeter of the tile $10_A$ may be framed by a moderately raised rib $19_A$. The divider 18 is disposed perpendicularly to those portions of the rib $19_A$ which overlie the lateral, or side, edges $11_A$ and $11_B$ of the tile $10_A$, and, in fact, the divider 18 may merge into the rib $19_A$.

The length of the laterally spaced sides 20A and 21A on indicia-presenting portion 16A are each equal to the length of the orthogonal end, or transverse side, 22A of the indicia-presenting portion 16A. Similarly, the length of the laterally spaced sides 20B and 21B on indicia-presenting portion 16B are each equal to the length of the orthogonal end, or transverse side, 22B of the indicia-presenting portion 16B. As depicted, the rib $19_A$ conveniently extends along all sides 20, 21 and 22 of the tile $10_A$. Moreover, because the playing face $15_A$ is orthogonal, both indicia-presenting portions 16A and 16B are also orthogonal. Hence, the included angle $\Theta_1$ between the side 20A and the transverse side 22A is equal to ninety degrees (90°). The angle $\Theta_2$ between side 21A and transverse side 22A, as well as the angle $\Theta_3$ between the side 20B and transverse side 22B and the angle $\Theta_4$ between side 21B and transverse side 22B are, therefore, also equal to ninety degrees (90°).

The rib $19_A$ and divider 18 which combine to frame each indicia-presenting portion 16A and 1613 may serve to protect any indicia 25 imprinted, or otherwise provided, on the indicia-presenting portions 16. The indicia $25_A$ depicted on indicia-presenting portion 16A constitutes a single dot, and the indicia $25_B$ depicted on indicia-presenting portion 16B constitutes two (2) dots. As will become apparent, the indicia 25 may be one (1) through six (6) dots, or the indicia 25 may be a blank. As is well known, various combinations of one through six dots and the blanks will provide twenty-eight (28) distinct, rectangular tile $10_A$.

As previewed in the previous two paragraph, and as will appear in the detailed description which follows, a particular structural member, component or arrangement may be employed at more than one location. When referring generally to that type of structural member, component or arrangement a common numerical designation shall be employed. However, when one of the structural members, components or arrangements so identified is to be individually designated it shall be referenced by virtue of a letter suffix employed in combination with the numerical designation employed for general identification of that structural member, component or arrangement.

Thus, there are a pair of indicia-presenting portions on the playing face $15_A$. The indicia-presenting portions are generally identified by the numeral 16, but the specific, individual indicia-presenting portions are, therefore, identified as portions 16A and 16B in the specification and on the drawings.

On the other hand, when the structural members, components or arrangements are similar, but not exactly the same, a common numerical designation shall still be employed, but when the similar members, components or arrangements so identified are to be specifically designated, they shall be referenced by virtue of a letter subscript employed in combination with the numerical designation employed for general identification of that structural member, component or arrangement. Thus, there are a similar, but distinct, indicia on portions 16A and 16B of the playing face $15_A$. The indicia are generally identified by the numeral 25, but the specific, individual indicia are, therefore, identified by the alphanumeric designations $25_A$, $25_B$ etc. in the specification and on the drawings.

These same alphanumeric conventions shall be employed throughout the specification.

To assist in aligning the transverse end edge surfaces 12 of an orthogonal indicia-presenting portion 16 in some of the hereinafter described tile displays, the center of the orthogonal sides 22A and 22B delineating the transverse end edge surfaces 12A and 12B of tile $10_A$ are preferably designated with an index pointer 27.

The lateral dimension, or width, of the tile $10_A$ is designated as "W", and the longitudinal dimension, or length, of the tile $10_A$ measured along the centerline ℄ is designated as "L".

Figure 3:
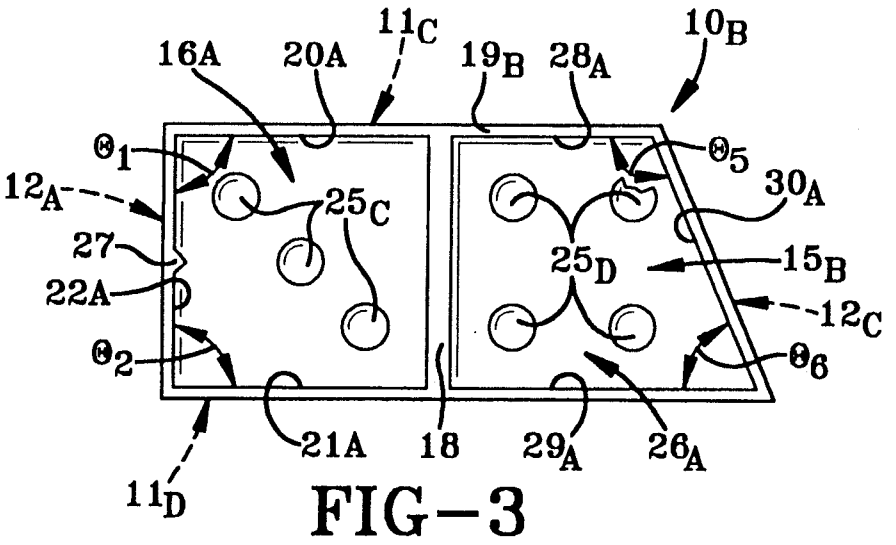
FIG. 3 is a plan view of a novel placement tile adapted for use in the tile placement game to which the present invention is directed, the tile having an obverse playing face in the configuration of a trapezoid with one of the short sides intersecting one of the parallel sides at an included angle of ninety degrees (90°) to define a rectangular indicia-presenting portion and with the other of the short edges intersecting the parallel sides at an included angle of sixty-seven and one-half degrees (67½°) to define a trapezoidal indicia-presenting portion.
Figure 4:
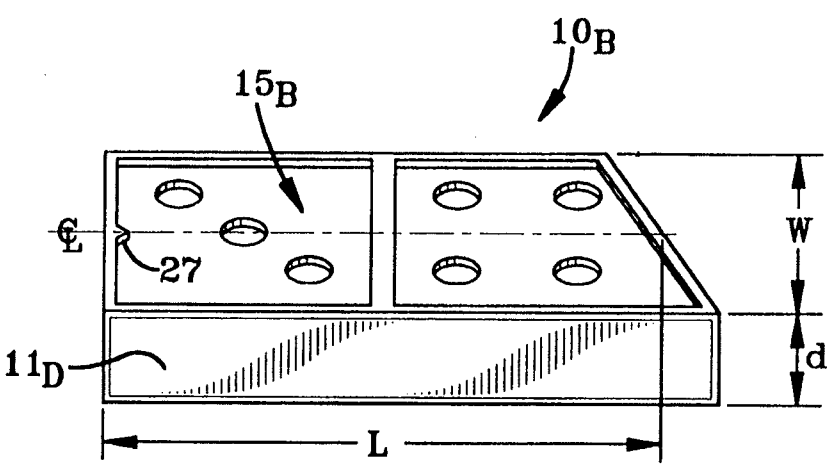
FIG. 4 is a perspective view of the playing tile depicted in FIG. 3.

The playing tile $10_B$ shown in FIGS. 3 and 4 has a trapezoidal playing face $15_B$. The tile $10_B$ is delineated by laterally spaced, parallel, side edge surfaces $11_C$ and $11_D$ as well as by transverse end edge surfaces $12_A$and $12_C$. The playing face $15_B$ is divided into two, indicia-presenting portions 16A and $26_A$. The indicia-presenting portions 16A and $26_A$ are preferably of equal areas, even though the indicia-presenting portion 16A is a square (as is portion 16A on tile $10_A$) and the indicia-presenting portion $26_A$ is trapezoidal.

As such, the length of the laterally spaced sides 20A and 21A on indicia-presenting portion 16A of tile $10_B$ are each equal to the length of the end, or transverse side, 22A of the indicia-presenting portion 16A. Because the indicia-presenting portion 16A is orthogonal, the included angle $\Theta_1$ between the side 20A and the transverse side 22A as well as the angle $\Theta_2$ between side 21A and transverse side 22A is each equal to ninety degrees (90°).

Here, too, the center of the orthogonal side $22_A$ delineating the transverse end edge $12_A$ of tile $10_B$ is designated with an index pointer 27, and the lateral dimension, or length, of the tile $10_B$ measured along the centerline ℄ is designated as "L".

The indicia-presenting portion $26_A$ is bounded by laterally spaced, parallel sides $28_A$ and $29_A$ (which are coaxial with the respective sides 20A and 21A of indicia-presenting portion 16A) and an angularly inclined, or oblique, transverse side $30_A$. For convenience, the side 28 is, and shall hereinafter be, shorter than the side 29, which is laterally spaced with respect to the parallel side 28, on each of the trapezoidal indicia-presenting portions 26.

The average length of the laterally spaced sides $28_A$ and $29_A$ on indicia-presenting portion $26_A$ of tile $10_B$ is equal to the length of either side 20A or 21A of the indicia-presenting portion 16A. In other words, the sum of the lengths of the parallel sides $28_A$ and $29_A$ divided by two is equal to the length of side 20A or 21A.

The indicia-presenting portion $26_A$ is trapezoidal, and the included angle $\Theta_5$ between the side $28_A$ and the oblique, transverse side $30_A$ is selected to equal one hundred, twelve and one-half degrees (112½°). Because the sides $28_A$ and $29_A$ are parallel, the included angle $\Theta_6$ between side $29_A$ and the oblique, transverse side $30_A$ is equal to sixty-seven and one-half degrees (67½°).

The indicia-presenting portion 16A and $26_A$ are also separated by divider 18 and may be framed with a moderately raised rib $19_B$ to protect any indicia 25 imprinted on the indicia-presenting portions 16A and $26_A$. The indicia $25_C$ depicted on indicia-presenting portion 16A constitutes three (3) dots, and the indicia $25_D$ depicted on indicia-presenting portion $26_A$ constitutes four (4) dots.

As with the tile $10_A$, the indicia-presenting portions 16A and $26_A$ on tile $10_B$ can have any indicia 25 between one (1) and six (6) dots or be blank. Inasmuch as a distinctly different tile results when indicia $25_C$ constitutes four (4) dots, and the indicia $25_D$ constitutes three (3) dots, the trapezoidal tile $10_B$ can have significantly more combinations than the rectangular tile $10_A$. In fact, the tile $10_B$ can have forty-nine (49) distinctly different combinations of blanks and dots. The only combinations that cannot be swapped between the square portion 16A and the trapezoidal section $26_A$ are the doubles. That is, only one double-blank tile, one double-one tile, etc. can be used.

The tile $10_B$ may also have a thickness "d" that is preferably equal to the thickness of the tile $10_A$.

Figure 6:
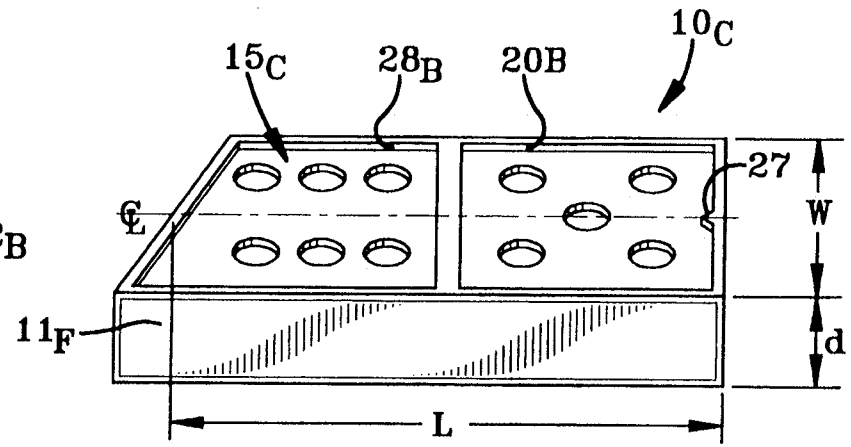
FIG. 6 is a perspective view of the playing tile depicted in FIG. 5.
Figure 5:
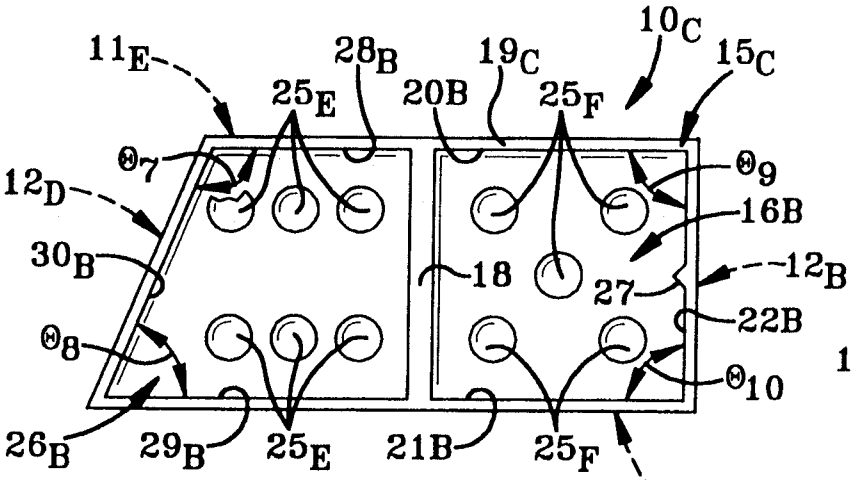
FIG. 5 is a plan view of a novel placement tile adapted for use in the tile placement game to which the present invention is directed, the tile being similar to, but the peripheral outline constitutes a mirror image of, the tile depicted in FIG. 3.

The tile $10_C$ shown in FIGS. 5 and 6 also has a trapezoidal playing face $15_C$. The tile $10_C$ is delineated by laterally spaced, parallel, side edge surfaces $11_E$ and $11_F$ as well as by transverse end edge surfaces $12_D$ and $12_B$. Tile $10_C$ is similar to the tile $10_B$ shown in FIGS. 3 and 4, but with the exception that the square indicia-presenting portion 16B is transposed with respect to the trapezoidal portion $26_B$—i.e.: the peripheral outlines of tile $10_B$ and $10_C$ are mirror images of each other. As such, the indicia-presenting portion $26_B$ is bounded by laterally spaced, parallel sides $28_B$ and $29_B$ and an angularly inclined, or oblique, transverse side $30_B$. The average length of the laterally spaced sides $28_B$ and $29_B$ on indicia-presenting portion $26_B$ of tile $10_C$ is equal to the length of either side 20B or 21B of the indicia-presenting portion 16B.

The indicia-presenting portion $26_B$ is trapezoidal, and the included angle $\Theta_7$ between the side $28_B$ and the oblique, transverse side $30_B$ is selected to equal one hundred, twelve and one-half degrees (112½°). Inasmuch as the sides $28_B$ and $29_B$ are parallel, the included angle $\Theta_8$ between side $29_B$ and the oblique, transverse side $30_B$ is equal to sixty-seven and one-half degrees (67½°).

Because the indicia-presenting portion 16B is square, the length of the laterally spaced sides 20B and 21B (which are coaxial with the sides $28_B$ and $29_B$) on indicia-presenting portion 16B are each equal to the length of the end, or transverse side, 22B thereof. The orthogonal configuration of the indicia-presenting portion 16B determines that the included angle $\Theta_9$ between the side 20B and the transverse side 22B as well as the included angle $\Theta_{10}$ between side 21B and transverse side 22B are each equal to ninety degrees (90°).

Here, too, the center of the orthogonal side $22_B$ delineating the transverse end edge $12_B$ of tile $10_C$ is designated with an index pointer 27, and the lateral dimension, or length, of the tile $10_C$ measured along the centerline ℄ is designated as "L".

As with the tile $10_B$, the indicia-presenting portions $26_B$ and 16B on tile $10_C$ are also separated by a divider 18 and may be framed with a modestly raised rib $19_C$ to protect the indicia 25 appearing thereon. The indicia $25_E$ depicted on indicia-presenting portion $26_B$ constitutes six (6) dots, and the indicia $25_F$ depicted on indicia-presenting portion 16B constitutes five (5) dots. However, as is also the situation with tile $10_B$ the tile $10_C$ can have any indicia between one (1) and six (6) dots or be blank. The tile $10_C$, like its mirror image tile $10_B$, can have forty nine (49) distinctly different combinations of the indicia 25.

Figure 8:
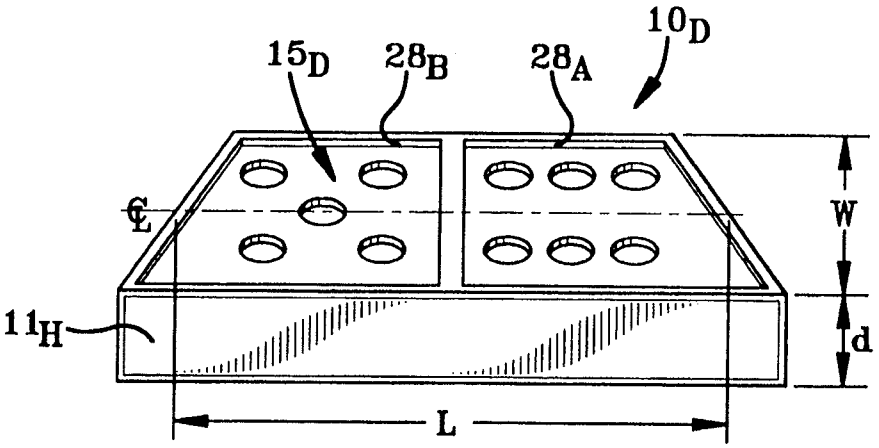
FIG. 8 is a perspective view of the playing tile depicted in FIG. 7.
Figure 7:
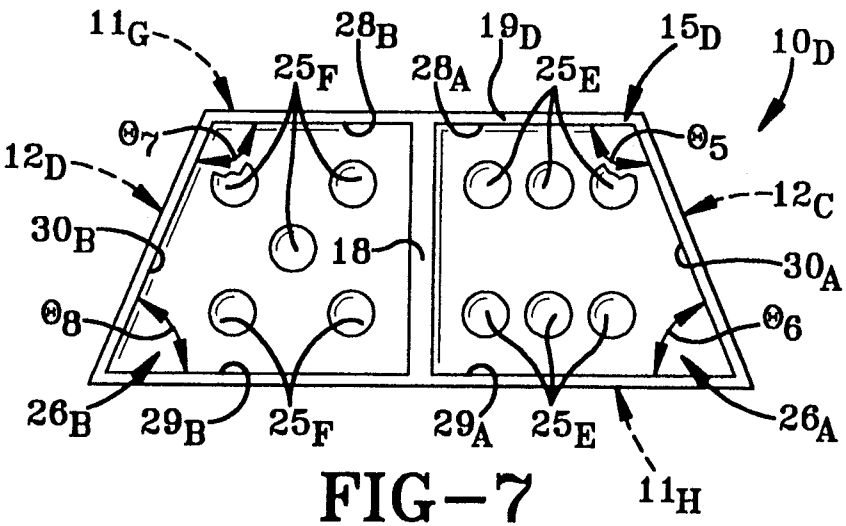
FIG. 7 is a plan view of yet another novel placement tile adapted for use in the tile placement game to which the present invention is directed, the tile having an obverse playing face in the configuration of a trapezoid with both of the short sides intersecting one of the parallel sides at an included angle of sixty-seven and one-half degrees (67½°)

The tile $10_D$ shown in FIGS. 7 and 8 presents a playing face $15_D$ having a third variety of a trapezoidal shape. The tile $10_D$ is delineated by laterally spaced, parallel, side edge surfaces $11_G$ and $11_H$ as well as by transverse end edge surfaces $12_D$ and $12_C$. The trapezoidal playing face $15_D$ is divided into two, indicia-presenting portions $26_A$ and $26_B$. The indicia-presenting portions $26_A$ and $26_B$ are also of preferably equal areas, not only to each other, but also with respect to all the other indicia-presenting areas 26. The indicia-presenting portions $26_A$ and $26_B$ are each trapezoidal, and the laterally spaced, parallel sides $28_A$ and $29_A$ bounding indicia-presenting portion $26_A$ are coaxial with respect to the laterally spaced parallel sides $28_B$ and $29_B$ of indicia-presenting portion $26_B$.

The opposite end edges of the playing face $15_D$ are respectively defined by the angularly inclined, or oblique, transverse side $30_A$ (of indicia-presenting portion $26_A$) and the angularly inclined, or oblique, transverse side $30_B$ (of indicia-presenting portion $26_B$). As shown, the oblique, transverse sides $30_A$ and $30_B$ are inclined in opposite directions, That is, the included angle $\Theta_5$ between the side $28_A$ and the oblique, transverse side $30_A$ is selected to equal one hundred, twelve and one-half degrees (112½°), and, because the sides $28_A$ and $29_A$ are parallel, the included angle $\Theta_6$ between side $29_A$ and the oblique, transverse side $30_A$ is equal to sixty-seven and one-half degrees (67½°). Similarly, the included angle $\Theta_7$ between the side $28_B$ and the oblique, transverse side $30_B$ is selected to equal one hundred, twelve and one-half degrees (112½°), and, because the sides $28_B$ and $29_B$ are parallel, the included angle $\Theta_8$ between side $29_B$ and the oblique, transverse side $30_B$ is equal to sixty-seven and one-half degrees (67½°).

The indicia-presenting portion $26_A$ and $26_B$ are also separated by divider 18 and may be framed with a moderately raised rib $19_D$ to protect any indicia 25 imprinted on the indicia-presenting portions $26_A$ and $26_B$. The indicia $25_E$ depicted on indicia-presenting portion $26_A$ constitutes six (6) dots, and the indicia $25_F$ depicted on indicia-presenting portion $26_B$ constitutes five (5) dots.

As with the previously described tile 10, the indicia-presenting portions $26_A$ and $26_B$ on tile $10_D$ can have any indicia 25 between one (1) and six (6) dots or be blank. Here, too, a distinctly different tile results when the indicia $25_F$, which constitutes five (5) dots, and the indicia $25_E$, which constitutes six (6) dots are reversed. Hence, the trapezoidal tile $10_D$ can have significantly more combinations than the rectangular tile $10_A$. In fact, the tile $10_D$ can also have forty-nine (49) distinctly different combinations of blanks and dots. Here, too, the only combinations that cannot be swapped between the trapezoidal sections $26_A$ and $26_B$ are the doubles.

The tile $10_D$ may also have a thickness "d" that is preferably equal to the thickness of the previously described tile 10. Here, too, the lateral dimension, or length, of the tile $10_D$ measured along the centerline ℄ is designated as "L".

Figure 10:
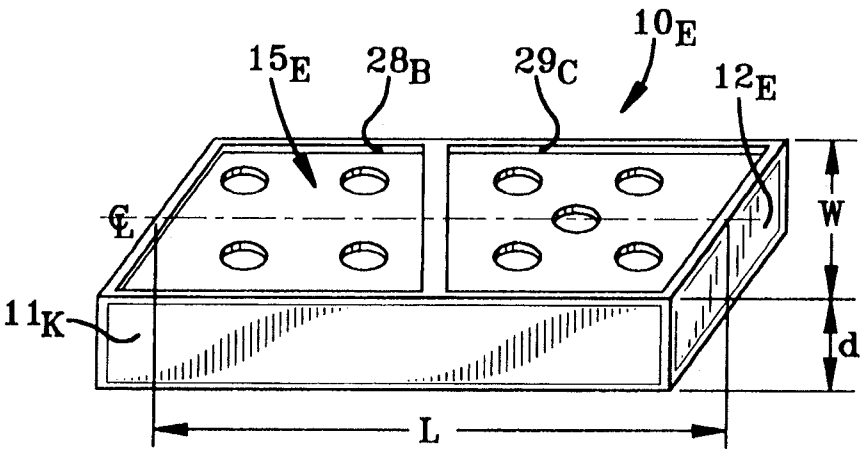
FIG. 10 is a perspective view of the playing tile depicted in FIG. 9.
Figure 9:
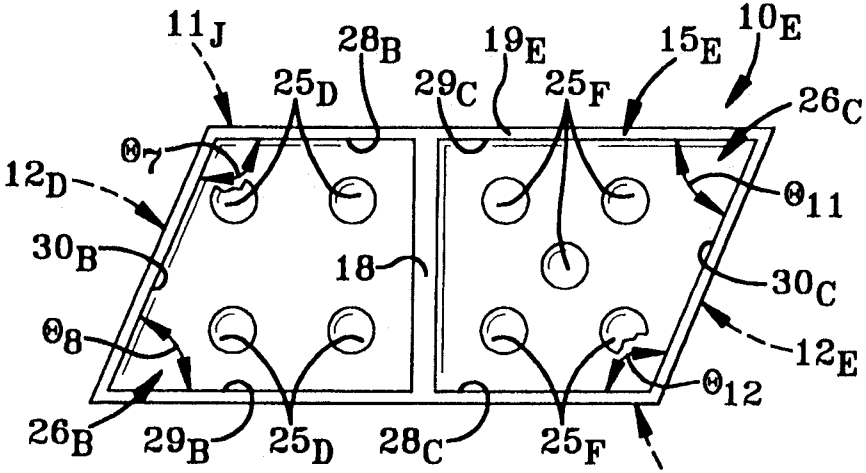
FIG. 9 is a plan view of a novel placement tile adapted for use in the tile placement game to which the present invention is directed, the tile having an obverse playing face in the configuration of a rhomboid with the shorter sides intersecting opposite parallel sides at an included angle of sixty-seven and one-half degrees (67½°)

The tile $10_E$ shown in FIGS. 9 and 10 has a rhomboid-shaped playing face $15_E$. The tile $10_E$ is delineated by laterally spaced, parallel, side edge surfaces $11_J$ and $11_K$ as well as by transverse end edge surfaces $12_D$ and $12_E$. The laterally spaced, parallel, longer, side edge surfaces $11_J$ and $11_K$ are of equal length. The laterally spaced, parallel, end surfaces $12_D$ and $12_E$ are also of equal length, but not equal to the length of the edge surfaces $11_J$ and $11_K$. The playing face $15_E$ is divided into two, indicia-presenting portions $26_B$ and $26_C$. The indicia-presenting portions $26_B$ and $26_C$ are also of preferably equal areas, not only to each other, but also with respect to all the other indicia-presenting areas 26. The indicia-presenting portions $26_B$ and $26_C$ are each trapezoidal, and the laterally spaced, parallel sides $29_C$ and $28_C$ bounding indicia-presenting portion $26_C$ are coaxial with respect to the laterally spaced, parallel sides $28_B$ and $29_B$ of indicia-presenting portion $26_B$.

The opposite ends of the playing face $15_D$ are respectively defined by the angularly inclined, or oblique, transverse side $30_B$ (of indicia-presenting portion $26_B$) and the angularly inclined, or oblique, transverse side $30_C$ (of indicia-presenting portion $26_C$). As shown, the oblique, transverse sides $30_B$ and $30_C$ are parallel. As such, the included angle $\Theta_7$ between the side $28_B$ and the oblique, transverse side $30_B$ is selected to equal one hundred, twelve and one-half degrees (112½°), and, because the sides $28_B$ and $29_B$ are parallel, the included angle $\Theta_8$ between side $29_B$ and the oblique, transverse side $30_B$ is equal to sixty-seven and one-half degrees (67½°). Similarly, the included angle $\Theta_{11}$ between the side $29_C$ and the oblique, transverse side $30_C$ is selected to equal sixty-seven and one-half one-half degrees (67½°), and, because the sides $29_C$ and $28_C$ are parallel, the included angle $\Theta_{12}$ between side $28_C$ and the oblique, transverse side $30_C$ is equal to one hundred, twelve and one-half degrees (112½°).

The indicia-presenting portions $26_B$ and $26_C$ are also separated by a divider 18 and may be framed with a moderately raised rib $19_E$ to protect any indicia 25 imprinted on the indicia-presenting portions $26_B$ and $26_C$. The indicia $25_D$ depicted on indicia-presenting portion $26_B$ constitutes four (4) dots, and the indicia $25_F$ depicted on indicia-presenting portion $26_C$ constitutes five (5) dots.

As with the previously described tile 10, the indicia-presenting portions $26_B$ and $26_C$ on tile $10_E$ can have any indicia 25 between one (1) and six (6) dots or be blank. It should be appreciated that the tile $10_E$ can be rotated one hundred, eighty degrees (180°) on a playing surface such that the indicia-presenting portion $26_C$ would be on the left, and the indicia-presenting portion $26_B$ would be on the right. However, this is indistinguishable from a rhomboid-shaped tile $10_E$ having five (5) dots in indicia-presenting portion $26_B$ and four (4) dots in indicia-presenting portion $26_C$. Therefore, a rhomboid-shaped tile is limited to twenty-eight (28) distinctly different indicia combinations. This is the same as tile $10_A$.

The tile $10_E$ may also have a thickness "d" that is preferably equal to the thickness of the previously described tile 10. Here, too, the lateral dimension, or length, of the tile $10_E$ measured along the centerline ℄ is designated as "L".

Figure 12:
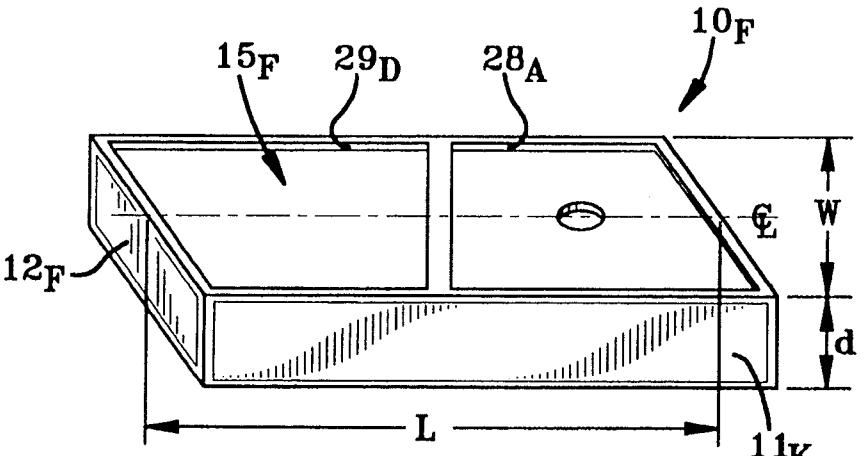
FIG. 12 is a perspective view of the playing tile depicted in FIG. 11.
Figure 11:
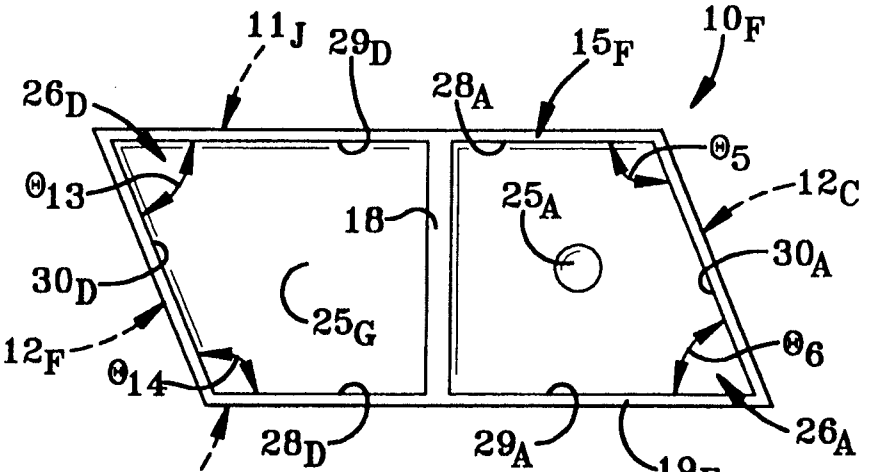
FIG. 11 is a plan view of a novel placement tile adapted for use in the novel tile placement game to which the present invention is directed, the tile being similar to, but the peripheral outline constitutes a mirror image of, the tile depicted in FIG. 9.

The tile $10_F$ shown in FIGS. 11 and 12 also has a rhomboid playing face $15_F$. The tile $10_F$ is delineated by laterally spaced, parallel, side edge surfaces $11_J$ and $11_K$ as well as by transverse, end edge surfaces $12_F$ and $12_C$. The tile $10_F$ is similar to tile $10_E$ shown in FIGS. 9 and 10 but with the difference that the peripheral outlines of tile $10_F$ and tile $10_E$ are mirror images. As such, the rhomboid-shaped playing face $15_F$ has laterally spaced, parallel, longer, side edge surfaces $11_J$ and $11_K$. The side edge surfaces $11_J$ and $11_K$ are of equal length. The rhomboid-shaped playing face $15_F$ also has laterally spaced, parallel, angularly inclined, or oblique, end edge surfaces $12_F$ and $12_C$ that are also of equal length, but not equal to the length of the edge surfaces $11_J$ and $11_K$. The playing face $15_F$ is divided into two, indicia-presenting portions $26_A$ and $26_D$. The indicia-presenting portions $26_A$ and $26_D$ are also of preferably equal areas, not only to each other, but also with respect to all the other indicia-presenting areas 26. The indicia-presenting portions $26_A$ and $26_D$ are each trapezoidal, and the laterally spaced, parallel sides $29_D$ and $28_D$ bounding indicia-presenting portion $26_D$ are coaxial with respect to the laterally spaced, parallel sides $28_A$ and $29_A$, respectively, of indicia-presenting portion $26_A$.

The opposite ends of the playing face $15_F$ are respectively defined by the angularly inclined, or oblique, transverse side $30_A$ (of indicia-presenting portion $26_A$) and the angularly inclined, or oblique, transverse side $30_D$ (of indicia-presenting portion $26_D$). As shown, the oblique, transverse sides $30_A$ and $30_D$ are parallel. As such, the included angle $\Theta_{13}$ between the side $29_D$ and the oblique, transverse side $30_C$ is selected to equal sixty-seven and one-half degrees (67½°), and, because the sides $29_D$ and $28_D$ are parallel, the included angle $\Theta_{14}$ between side $28_D$ and the oblique, transverse side $30_C$ is equal to one hundred, twelve and one-half degrees (112½°). Similarly, the included angle $\Theta_5$ between the side $28_A$ and the oblique, transverse side $30_A$ is selected to equal one hundred, twelve and one-half degrees (112°), and, because the sides $28_A$ and $29_A$ are parallel, the included angle $\Theta_6$ between side $29_A$ and the oblique, transverse side $30_A$ is equal to one sixty-seven and one-half degrees (67½°).

The indicia-presenting portions $26_A$ and $26_D$ are also separated by a divider 18 and may be framed with a moderately raised rib $19_F$ to protect any indicia 25 imprinted on the indicia-presenting portions $26_A$ and $26_D$. The indicia $25_A$ depicted on indicia-presenting portion $26_A$ constitutes one (1) dot, and the indicia $25_G$ depicted on indicia-presenting portion $26_D$ constitutes a blank.

As with the previously described tile 10, the indicia-presenting portions $26_A$ and $26_D$ on tile $10_F$ can have any indicia 25 between one (1) and six (6) dots or be blank. It should be appreciated that the tile $10_F$ can be rotated one hundred, eighty degrees (180°) on a playing surface such that the indicia-presenting portion $26_A$ would be on the left, and the indicia-presenting portion $26_D$ would be on the right. However, this is indistinguishable from a rhomboid-shaped tile $10_F$ having a blank indicia $25_A$ on indicia-presenting portion $26_A$ and a one (1) dot indicia $25_A$ on indicia-presenting portion $26_D$. Therefore, a rhomboid-shaped tile is limited to twenty-eight (28)

distinctly different indicia combinations. This is the same as tile $10_A$ and $10_E$.

The tile $10_F$ may also have a thickness "d" that is preferably equal to the thickness of the previously described tile 10. Here, too, the lateral dimension, or length, of the tile $10_F$ measured along the centerline ℄ is designated as "L".

To provide a brief recap, each of the trapezoidal indicia-presenting portions $26_A$ through $26_D$ are equal in area to each of the rectangular indicia-presenting portions 16A and 16B. To accomplish that equality, the average length of the side edge surfaces on each trapezoidal tile $10_B$ through $10_D$ and each rhomboidal tile $10_E$ and $10_F$ is equal to the length of the side edge surfaces 11 on the rectangular tile $10_A$. The transverse dimension "W" of each tile must be equal as must the longitudinal dimension "L" thereof. In addition, the thickness "d" of each of the tile should also be equal. Thus, the only difference between the tile 10 is the disposition of the oblique side 30 on the trapezoidal indicia-presenting portion 26. The oblique sides 30 on all trapezoidal indicia-presenting portions 26 have the same two angles at the intersection of the oblique side 30 with the laterally spaced, parallel sides 20, 21, 28 and 29, and those angles are, on all non-rectangular tile, equal to sixty-seven and one-half degrees (67½°) and one hundred, twelve and one-half degrees (112½°).

In addition, the average length of the laterally spaced, parallel, longer, side edge surfaces $11_J$ and $11_K$ on the rhomboid tile $10_E$ and $10_F$ is equal to the length of the longer, side edge surfaces 11 on the rectangular tile $10_A$. The laterally spaced, parallel, side edge surfaces $11_C$ through $11_H$ of the trapezoidal tile $10_B$ through $10_D$ have an average length equal to the length of the longer sides $11_A$ or $11_B$ of the rectangular tile $10_A$. The average length of the longer sides $11_A$ and $11_B$ is equal to the longitudinal centerline dimension "L".

Figure 13:
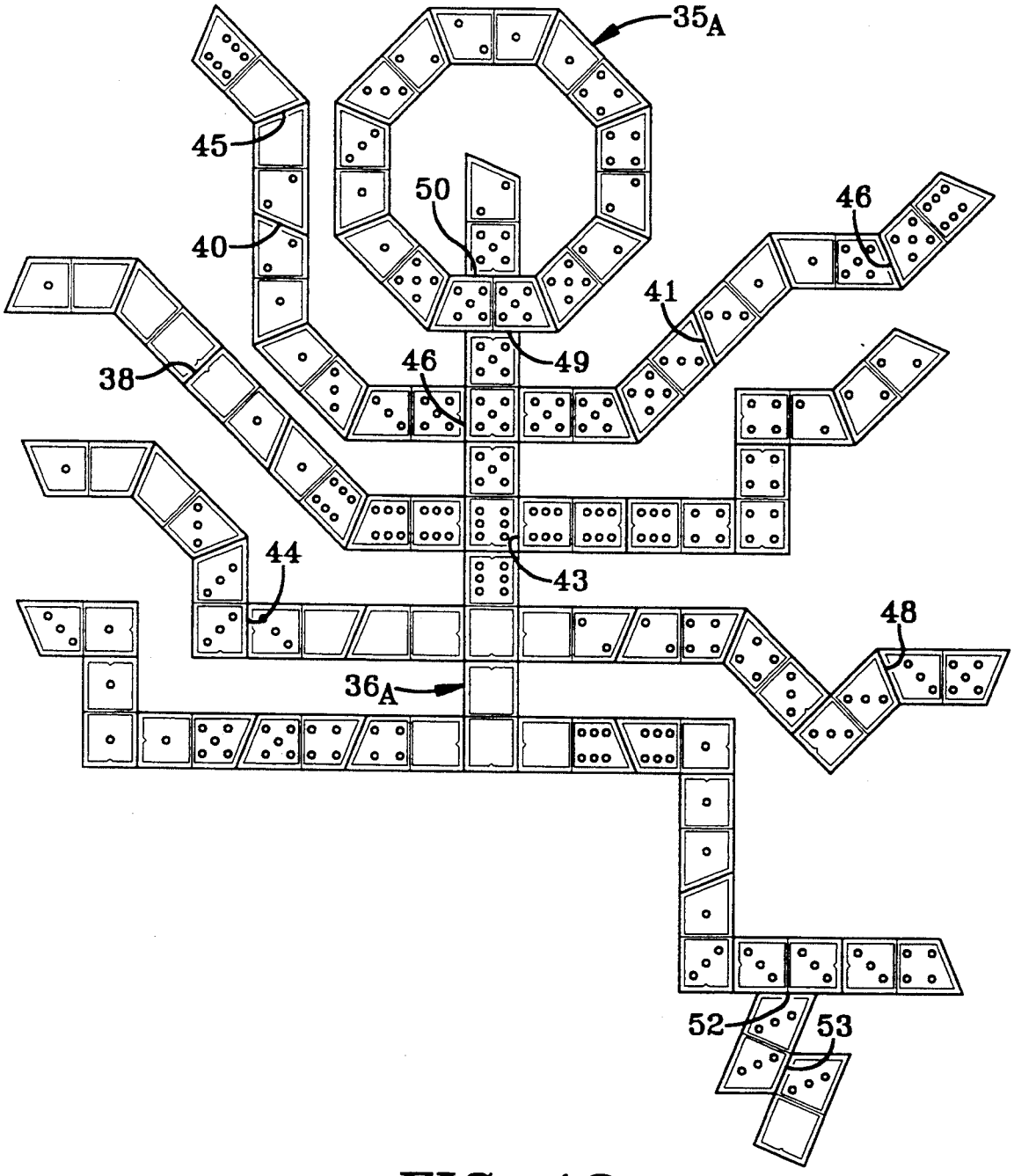
FIG. 13 is a plan view of one configuration that might be formed by contestants playing the improved tile placement game according to the concepts of the present invention; and, FIG. 14 is a plan view of another configuration that might be formed by contestants playing the improved tile placement game according to the concepts of the present invention.
Figure 14:
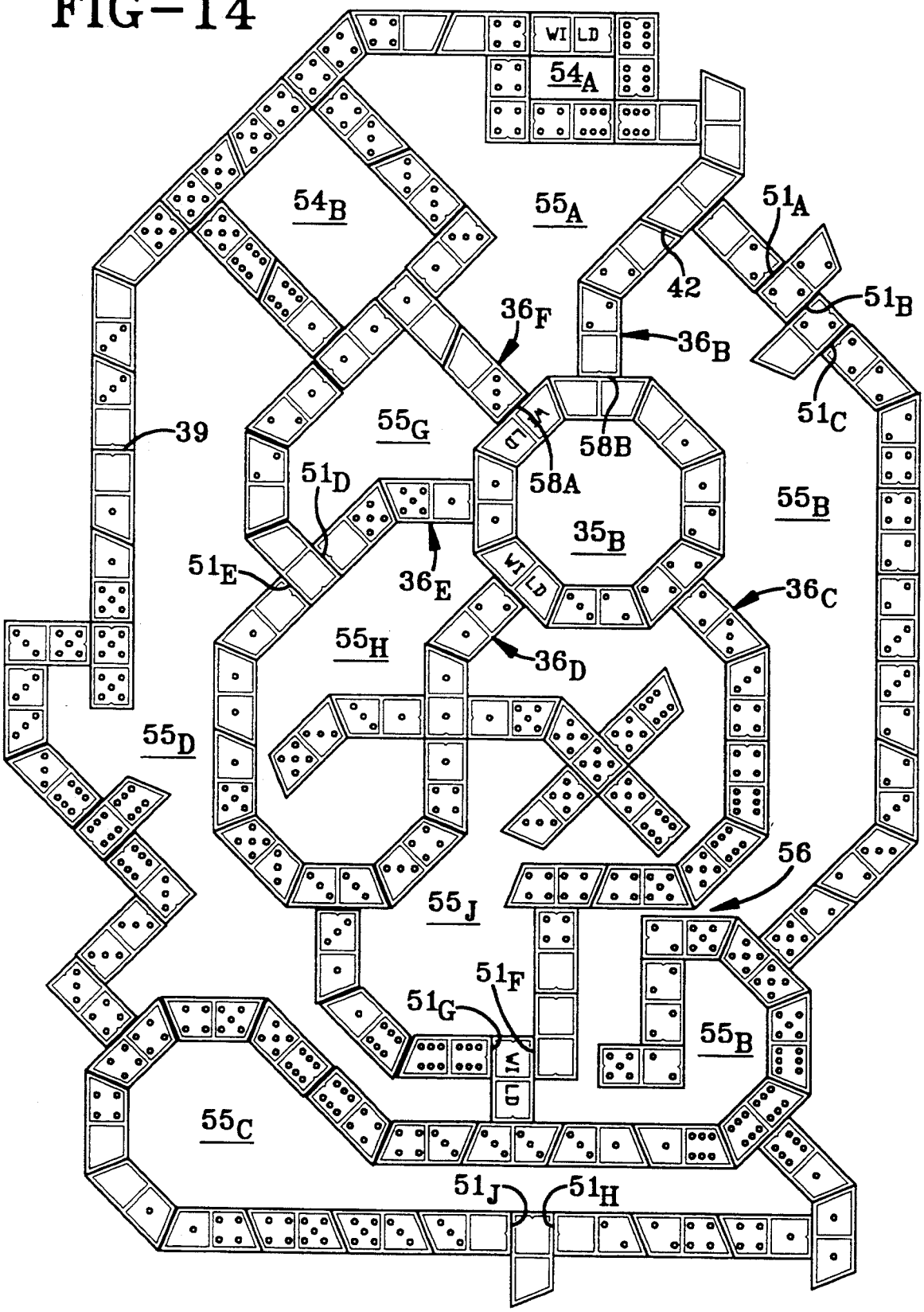

The tile $10_A$ through $10_F$ thus provide a total of two hundred, thirty-one (231) tile that comprise six, distinctly different, playing pieces. Those tile can be combined in a plurality of arrangements in accordance with the rules that, while different, are no more difficult than the rules for the historic domino game. FIGS. 13 and 14 exhibit two of the virtually unlimited arrangements that are possible with the games played using tile 10 embodying the concepts of the present invention. The oblique end edges of the trapezoidal tile $10_B$ through $10_D$ as well as the rhomboidal tile $10_E$ and $10_F$ permit the arrangements to be other than orthogonal. This is a definite advantage over historic versions of the game of dominos.

As seen in FIGS. 13 and 14, the arrangement of the tile can have both orthogonal segments and non-orthogonal segments that are interfaced. The trapezoidal tile $10_D$, for example, can be constructed into an octagon, as represented at $35_A$ and $35_B$, from which a linear segment, or segments, such as represented at $36_A$ through $36_F$ may extend. The linear segments may begin with any tile 10 having at least one orthogonal end.

Linear segments may be formed by using combinations of each of the various tile. Representative linear segments of the display depicted in FIG. 13 may be formed by abutting: the orthogonal end edges of two trapezoidal tile $10_B$ (as depicted at 38 in FIG. 13) or two trapezoidal tile $10_C$ (as depicted at 39 in FIG. 14); the oblique end edges of two trapezoidal tile $10_D$ (as represented at 40 in FIG. 13); or, the oblique end edges of two rhomboidal tile $10_E$ (as represented at 41 in FIG. 13) or two rhomboidal tile $10_F$ (as depicted at 42 in FIG. 14). Other combinations should now be readily apparent.

Representative angular segments may be accomplished, as in the historic domino game, by abutting an end edge on a rectangular tile $10_A$ with one side of an indicia-presenting portion of a rectangular tile $10_A$ (as depicted at 43 in FIG. 13). This results in an included angle of ninety degrees (90°). Similarly, orthogonal abutment can be accomplished by abutting the end edge of a rectangular tile $10_A$ with the side of an appropriate indicia-presenting portion on a trapezoidal tile $10_B$ (as depicted at 44 in FIG. 13).

Representative non-orthogonal angular displays can be accomplished by abutting: the oblique end edges on two trapezoidal tile $10_D$ (as depicted at 45 in FIG. 13); the oblique end edges of a rhomboidal tile $10_F$ with an oblique end edge of a trapezoidal tile $10_D$ (as depicted at 46 in FIG. 13); or, the oblique end edges of a trapezoidal tile $10_C$ with the oblique end edges of a trapezoidal tile $10_D$ (as depicted at 48 in FIG. 13). These abutments result in providing an included angle of one hundred and thirty-five degrees (135°).

Thus, the oblique end edges of tile $10_B$ through $10_F$ can be placed in abutment to form included angles of either one hundred, thirty-five degrees (135°) or one hundred, eighty degrees (180°). This will permit the construction of virtually an unlimited number of displays.

It is, of course, also possible to manufacture tile having different angular relationships between the oblique ends and the parallel edges of the tile. If, for example, it is desired to permit the construction of a dodecagon, the included angles of the sloping sides would be seventy-five degrees (75°) and one-hundred, five degrees (105°). It should be apparent, however, that as the included angles approach ninety degrees (90°), the more difficult it will be visually to discern between the oblique sides and the orthogonal sides. It is, therefore, considered that the included angles selected for the preferred embodiment establish a set of playing tile in which the oblique sides are readily distinguishable from the orthogonal sides and yet a polygon of a substantial number of sides is permitted.

To provide even further versatility to the game, a plurality of "wild card" tile could be added. For example, eight wild card tiles may be employed to enhance play without detracting from the challenge that is the essence of a tile game embodying the concepts of the present invention. These tile could have an indicia such as a jester's face or any logo that is distinguishable from the dots. In FIG. 14 the wild card tile are identified simply by the word WILD.

A tile placement game embodying the concepts of the present invention is preferably played with two to six persons in accordance with the following rules:

1. All playing tile 10 are placed on a table, playing face down, and thoroughly mixed, or "shuffled".

2. Each player draws four (4) playing tile of each basic shape —i.e.: one basic shape is the rectangular tile $10_A$; the second basic shape is represented by the trapezoidal tile $10_B$ and $10_C$ with one orthogonal end edge; the third basic shape is the trapezoidal tile $10_D$ having two oblique end edges; and, the fourth basic shape is represented by the rhomboidal tile $10_E$ and $10_F$ for a total of sixteen (16) tile. These tile are placed (on edge or in a rack) so that only the player who drew the tile can see the indicia appearing on the playing face. The remaining tile are left on the table an referred to as the "pile".

3. The player having the highest double indicia on a single tile plays first. If two players have equal doubles, they draw from the pile, and the player drawing the highest number of dots on the drawn tile plays first. If no doubles were drawn originally, the player with the highest number of dots on a single tile plays any of his tile first. Any ties are decided by drawing another tile, as above. The first tile is played by placing it face up on table of play.

4. The players proceed, in turn, alternately for two players or clockwise for three of more players.

5. All tile are played end-to-end with a matching indicia on the abutting indicia-presenting portions. However, the end edges must be of the same type, orthogonal-to-orthogonal and oblique-to-oblique in order to preclude overlap of the engaging ends.

6. Doubles are an exception: Any double-indicia tile having at least one orthogonal end edge may act as a "hub" to allow radial play or to allow right angle turns. Play must be from the end edge or either side edge of the orthogonal indicia-presenting portion. This rule permits, for example, the orthogonal end edge of a tile—such as a tile $10_A$ or a tile $10_C$—to abut either long side of a double-indicia, non-orthogonal tile such as $10_D$, as depicted at 49 and 50, respectively, in FIG. 13. To play correctly, the center of the orthogonal end edge must be aligned with the divider 18. In order to assist the accurate placement necessary to develop complex displays, such as depicted in FIGS. 13 and 14, the index pointer 27 is provided to assure the necessary alignment with the divider 18. This rule also permits plays such as identified at $51_A$ through $51_H$ and $51_J$ in FIG. 14. This rule does not, however, permit the oblique end of a non-orthogonal tile—such as the end edge $12_C$ on tile $10_F$—to abut one side edge of, for example, the double-indicia rectangular tile $10_A$, as depicted at 52, nor does it permit side edge abutment of trapezoidal indicia-presenting portions 26, such as depicted at 53 on FIG. 13 between two rhomboidal tile $10_F$. This rule is utilized to enhance the potential for symmetry and thus the ability to "close" geometric outlines, or loops, which would be less likely to close if abutments 52 and 53 were permitted, but obviously the scope of the subject invention is not limited by the restriction of such a rule.

7. The object of the game is to play all of ones tiles before the opponent(s) do. However, the duration of play may be extended by mutual consent of all players, if all players have the same number of unplayed tile. Play continues after each player has drawn and agreed number of additional tile from the "pile".

8. When a player is unable to play because he does not have a tile with a matching playing section, that player must draw tile from the "pile" until a playable tile is acquired. If the "pile" has been exhausted the player must pass and wait his next opportunity in the normal rotation.

9. Play continues until one player has played all of his tile. If no player is able to play, but no one has used all of his tile, the player with the lowest number of total dots on the tile remaining to be played by him is the winner. The winner receives a number of points equal to the total number of dots on all the tile held by the opponents. The players must agree on the total number of points necessary to be the grand winner before the game begins.

10. The rules can be changed by agreement of the players. For example, the successful closure of any loop of play, such as —the octagons $35_A$ and $35_B$, the rectangular portions $54_A$ and $54_B$ of the display and the freeform portions $55_A$ through $55_E$ of the display—can be awarded a predetermined number of points. It should be noted that freeform portion 55B passes through space 56, which could not constitute an abutment, even if the tile were contiguous in view of rule "6" above. If "wild card" tiles are used, they can be substituted for any possible indicia. Moreover, wild card tiles may also be substituted for lost, or missing, tiles.

An excellent example of the uniquely complex display arrangement that can result from a tile placement game embodying the concepts of the present invention is depicted in FIG. 14. It must be observed that whereas the purely symmetrical, rectangular portions 54 or the octagonal portions 35 close precisely, even if trigonometrically calculated, the freeform portions 55 of the display depicted in FIG. 14 cannot be theoretically closed with the precision of a trigonometric calculation. However, the disparity between mathematical precision and realistic manufacturing tolerances accommodates closure. For example, it requires fifteen (15) tile abutments to complete the freeform outline designated as 55A in FIG. 14, and yet closure is neatly accomplished with actual tiles. It should be understood that if one trigonometrically calculated the closure tile abutment 58A, when starting at abutment 58B to outline freeform 55A, a difference of twelve thousandths of an inch (0.012") per intermediate abutment would be determined—when using tile measuring two inches (2") along the centerline L (dimension "L") and having a one inch (1") transverse dimension (dimension "W"). This dimensional idiosyncrasy is noted merely to preclude some future nitpicker from attacking the veracity of the disclosure; it introduces no restriction to the play of a tile game embodying the concepts of the present invention.

The foregoing description of the exemplary embodiment of the invention has been presented for the purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

While only a preferred embodiment of my present invention is disclosed, it is to be clearly understood that the same is susceptible to numerous changes apparent to one skilled in the art. Therefore, the scope of the present invention is not to be limited to the details shown and described but is intended to include all changes and modifications which come within the scope of the appended claims.

As should now be apparent, the present invention not only teaches that a domino-type, tile placement game embodying the concepts of the present invention is capable of being played with a significantly increased number of distinctly different tile, but also that the other objects of the invention can be likewise accomplished.

I claim:

1. Tiles for a tile placement game, said tiles comprising:

a pair of laterally spaced, parallel, side edges and a pair of longitudinally spaced end edges extending transversely between said side edges to define an obverse playing face;

said playing surface divided into two indicia-presenting portions by a divider means extending substantially transversely between the side edges;

said indicia-presenting portions being both of rectangular outline on a first plurality of said tiles;

said indicia-presenting portions being one of rectangular outline and one of trapezoidal outline on a second plurality of said tiles;

said indicia-presenting portions being both of trapezoidal outline on a third plurality of said tiles;

said tiles being combined to provide a pool of tile for a single game using all of the tiles regardless of the shape of the indicia-presenting portions; and, preselected indicia provided on said indicia-presenting portions.

2. Tiles for a tile placement game, as set forth in claim 1, wherein:

each indicia-presenting portion on each plurality of tiles have three playing edges alignable in abutting relation with at least two correspondingly sized playing edges on at least one of the other pluralities of tiles during the playing of the tile placement game.

3. Tiles for a tile placement game, said tiles comprising:

a pair of laterally spaced, parallel, side edges and a pair of longitudinally spaced end edges extending transversely between said side edges to define an obverse playing face;

said playing surface divided into two indicia-presenting portions by a divider means extending substantially transversely between the side edges;

said indicia-presenting portions being one of rectangular outline and one of trapezoidal outline on a first plurality of said tiles;

said indicia-presenting portions being both of trapezoidal outline on a second plurality of said tiles;

said tiles being combined to provide a pool of tile for a single game using all of the tiles regardless of the shape of the indicia-presenting portions; and, preselected indicia provided on said indicia-presenting portions.

4. Tiles for a tile placement game, as set forth in claim 3, wherein:

each indicia-presenting portion on each plurality of tiles have three playing edges alignable in abutting relation with at least two correspondingly sized playing edges on the other plurality of tiles during the playing of the tile placement game.

5. Tiles for a tile placement game, said tiles comprising:

a pair of laterally spaced, parallel, side edges and a pair of longitudinally spaced end edges extending transversely between said side edges to define an obverse playing face;

said playing surface divided into two indicia-presenting portions by a divider means extending substantially transversely between the side edges;

said indicia-presenting portions being both of rectangular outline on a first plurality of said tiles;

said indicia-presenting portions being both of trapezoidal outline on a second plurality of said tiles;

said tiles being combined to provide a pool of tile for a single game using all of the tiles regardless of the shape of the indicia-presenting portions; and, preselected indicia provided on said indicia-presenting portions.

6. Tiles for a tile placement game, as set forth in claim 5, wherein:

each indicia-presenting portion on each plurality of tiles have three playing edges alignable in abutting relation with at least two correspondingly sized playing edges on the other plurality of tiles during the playing of the tile placement game.

7. A tile placement game comprising:

a plurality of hexahedron tile pieces having a plurality of first tile defining a first playing face having a rectangular outline divided into two equal area first and second rectangular, indicia-presenting portions having a predetermined indicia in each section, a plurality of second hexahedron tile pieces defining a second playing face having a trapezoidal outline divided into a rectangular indicia-presenting portion and a trapezoidal indicia-presenting portion having an oblique end edge, the indicia-presenting portions having identical areas and having predetermined indicia thereon;

a plurality of third hexahedron tile pieces that are the mirror image of said second hexahedron tile pieces;

a plurality of fourth hexahedron tile pieces defining a playing face having a trapezoidal outline divided into two trapezoidal indicia-presenting portions, each having an oblique end edge and each having predetermined indicia thereon;

a plurality of fifth hexahedron tile pieces defining a playing face having a rhomboidal outline divided into two trapezoidal indicia-presenting portions, each having an oblique end edge and each having predetermined indicia thereon;

a plurality of sixth hexahedron tile pieces that are the mirror image of said fifth hexahedron tile pieces;

said oblique end edge on any indicia-presenting portion being abuttable with the oblique end edge of any other indicia-presenting portion having an oblique end edge;

said indicia-presenting portions having identical areas and having predetermined indicia provided thereon;

said predetermined indicia being selected from a plurality of indicia such that some sections will have identical indicia.

8. Tile for playing a tile placement game, as set forth in claim 7, wherein:

said trapezoidal indicia-presenting portions each have a transverse, oblique end edge;

said oblique end edges are all of equal length.

9. Tile for playing a tile placement game, as set forth in claim 8, wherein:

said oblique end edge intersects at least one of said laterally spaced side edges surfaces at an included angles of approximately sixty-seven and one-half degrees ($67\frac{1}{2}°$).

* * * * *